US005688166A

United States Patent [19]

Chen

[11] Patent Number: 5,688,166

[45] Date of Patent: Nov. 18, 1997

[54] APPARATUS FOR COUNTING COINS

[76] Inventor: Chih-nan Chen, No. 132, Tinghsin Rd., Sanmin Dist., Kaohsiung, Taiwan

[21] Appl. No.: 677,835

[22] Filed: Jul. 10, 1996

[51] Int. Cl.[6] ..... G07D 1/00

[52] U.S. Cl. ..... 453/57; 453/49

[58] Field of Search ..... 453/39, 40, 49, 453/57, 18, 29, 30, 32–35, 50–54, 58, 63; 194/344, 346, 351

[56] References Cited

U.S. PATENT DOCUMENTS

| | | | |
|---|---|---|---|
| 3,698,537 | 10/1972 | Black et al. | 453/57 |
| 5,167,571 | 12/1992 | Waller | 453/57 X |
| 5,181,881 | 1/1993 | Abe | 453/57 |
| 5,254,032 | 10/1993 | Abe | 453/57 X |

FOREIGN PATENT DOCUMENTS

| | | | |
|---|---|---|---|
| 2231720 | 1/1973 | Germany | 453/57 |

*Primary Examiner*—Karen B. Merritt
*Assistant Examiner*—Scott L. Lowe
*Attorney, Agent, or Firm*—Gunn, Lee & Miller, PC

[57] ABSTRACT

An improved apparatus for sorting, counting and dispensing tokens such as coins used in games in which its driven member is composed of a driving block and a turntable set on a spindle of an electric motor so that a simple assembly can be achieved. The turntable is operated within the limitation of a ledge of a hopper so that threading connections can be omitted and the turntable will not separate from the hopper during operation. Furthermore, the improved apparatus has a stop lever mounted on the holder for preventing the tokens from falling from the delivery passages back to the turntable. The turntable is designed with a plurality of flanges extending integrally and upwardly from the surface thereof. The flanges are spaced and arranged to form a plurality of channels therebetween so that fingers of a block of the holder can extend into the channels to smoothly deliver the tokens.

5 Claims, 5 Drawing Sheets

APPARATUS FOR COUNTING COINS

BACKGROUND OF THE INVENTION

1. Field of the Invention

The present invention relates to an apparatus for sorting, counting and delivering tokens and, more particularly to an improved apparatus for counting tokens such as coins, whose driven member is composed of a driving block and a turntable set on a spindle of an electric motor so that a simple assembly can be achieved and whose turntable is operated within the limitation of a ledge of a hopper so that threading operations in manufacture can be omitted and the turntable will not separate from the hopper during rotation.

2. Description of Related Art

An apparatus for sorting, counting and dispensing tokens is generally used in games. A kind of conventional apparatus for counting tokens such as coins, with a reference to Taiwan Patent Publication No. 267595, there is disclosed a turntable connected with an electric motor for delivering tokens and a hopper for containing the tokens. The turntable defines a plurality of recesses spaced on the surface thereof for receiving the tokens. A plurality of grippers respectively extending from the periphery of the turntable is tilted along the radius of the table at an under surface of the turntable. Each gripper is located between adjacent recesses. Between the hopper and the holder, there is provided an opening for tokens to exit therethrough. A pair of jockey pulleys is disposed at the opening in order to guide the tokens from the turntable to the hopper by means of elastic force provided by a pair of springs connected with the jockey pulleys.

This kind of apparatus for sorting, counting and dispensing tokens requires a number of elements so that the assembly work is troublesome. Further, the token delivery is provided by means of the elastic force of the springs so that there is a possibility that the tokens will be stuck within the apparatus due to the deviation of the operation of the elements.

The present invention provides an improved apparatus for sorting, counting and dispensing tokens to mitigate and/or obviate the aforementioned problems.

SUMMARY OF THE INVENTION

One object of the present invention is to provide an improved apparatus for sorting, counting and dispensing tokens which has the advantages that the driven member thereof is composed of a driving block and a turntable set on a spindle of an electric motor so that a simple assembly can be achieved and that the turntable is operated within the limitation of a ledge of a hopper so that threading operations during manufacture can be omitted and the turntable will not separate from the hopper during rotation.

Another object of the present invention is to provide an improved apparatus for sorting, counting and dispensing tokens which has a stop lever mounted on the holder of the apparatus for preventing tokens from falling backwardly.

In accordance with one aspect of the present invention, the improved apparatus for sorting, counting and dispensing tokens comprises a housing, a holder obliquely mounted on the housing, said holder having a plurality of fingers disposed at an upper portion thereof. A turntable is rotatably mounted on the holder, said turntable defining a slot at a center thereof for receiving a driving block. A plurality of ducts is arranged annularly around the slot for respectively containing a plurality of ball race. A plurality of recesses are spaced and arranged annularly around the ducts for receiving the tokens. The turntable further has a plurality of flanges extending integrally and upwardly from the surface between each adjacent recess thereof. The fingers are spaced and arranged at positions radially outward of the surface between adjacent recesss so as to form a plurality of channels therebetween for the flanges of the holder to enter therein. A locating member is mounted on the holder and defines a first passage in communication with the turntable for tokens pass therealong. A guide member is mounted above the locating member and defines a second passage in communication with the first passage. A hopper for containing tokens is mounted to the holder over the turntable, the hopper defining a central hole with a diameter slightly larger than that of the turntable for mating with the turntable. A periphery of the central hole of the hopper has a ledge integrally extending from an upper portion of the periphery thereof in order to retain the turntable. The electric motor is mounted behind the housing to drive the turntable to rotate, whereby the tokens can be delivered one by one from the turntable to the hopper.

In accordance with another aspect of the present invention, the locating member comprises a first guide vane and a second guide vane sandwiched between a cover plate and a carrier plate, said first and second guide vane being spaced apart from each other to define the first passage therebetween.

In accordance with a further aspect of the present invention, the apparatus further comprises a stop lever having a first end thereof pivotedly mounted on the locating member at an appropriate position and a second end with a flexible portion blocking at an entry of the locating member in order to prevent the tokens from falling backward.

In accordance with still a further aspect of the present invention, the first and second guide vanes and said cover plate of the locating member can be made integrally.

Other objects, advantages and novel features of the invention will become more apparent from the following detailed description when taken in conjunction with the accompanying drawings.

DETAILED DESCRIPTION OF PREFERRED EMBODIMENT

Figure 1:
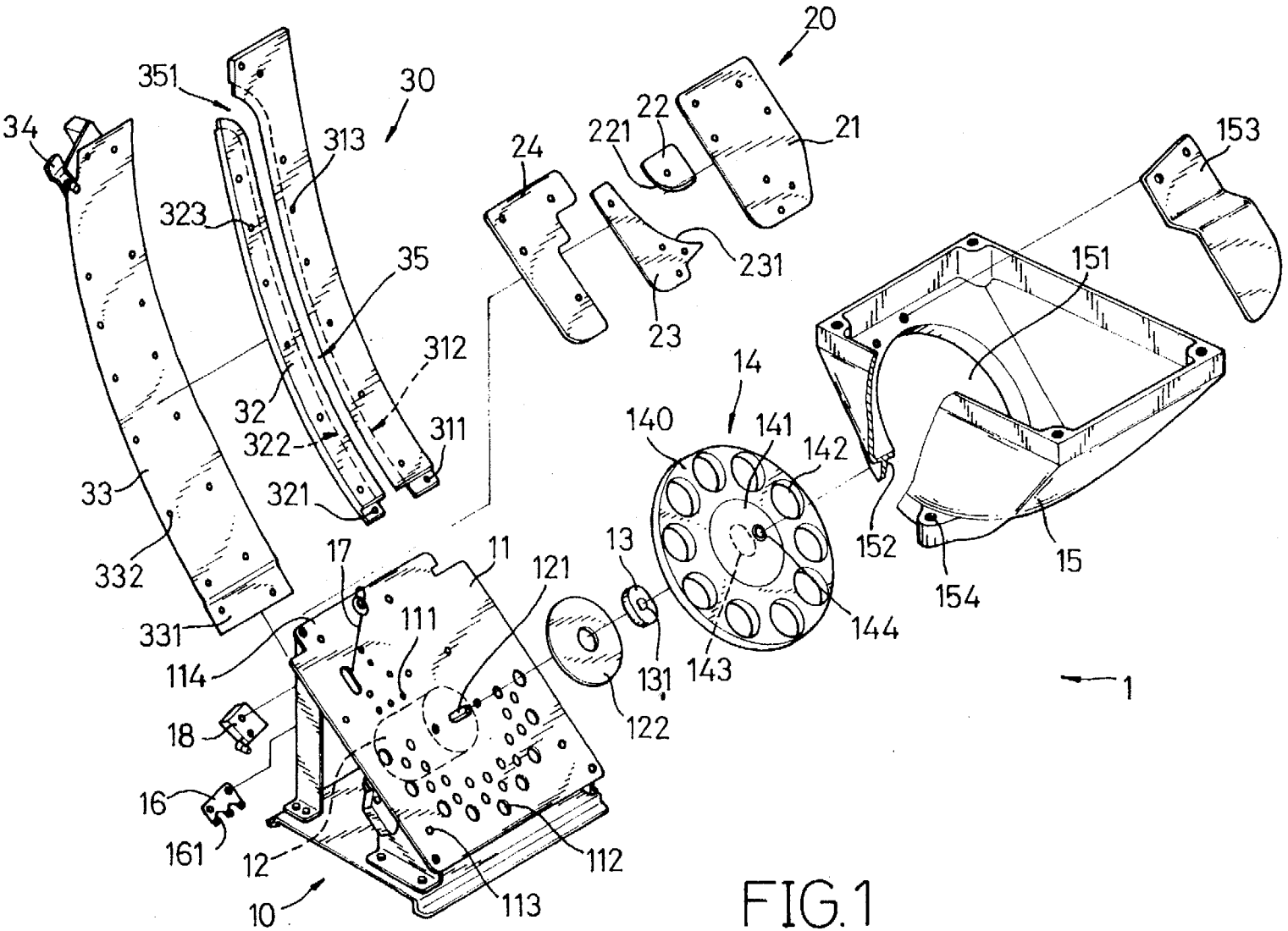
FIG. 1 is a perspective view showing the improved apparatus for sorting, counting and dispensing tokens in accordance with the present invention.

Referring to FIG. 1, there is a perspective view showing the improved apparatus 1 for sorting, counting and dispensing tokens in accordance with the present invention. The apparatus 1 comprises a housing 10 and a holder 11 obliquely mounted on the housing 10. The holder 11 defines a plurality of apertures 112 in a surface thereof for heat dissipation and a plurality of holes 111 at an upper portion thereof from which fingers 161 of a block 16 are inserted. The holder 11 further defines a plurality of locating holes 113 at appropriate position in the surface thereof by which a hopper 15 for receiving tokens is mounted to the holder 11. An electric motor 12 is mounted behind the holder 11, with a spindle 121 thereof extending through a center of the holder 11.

Figure 2:
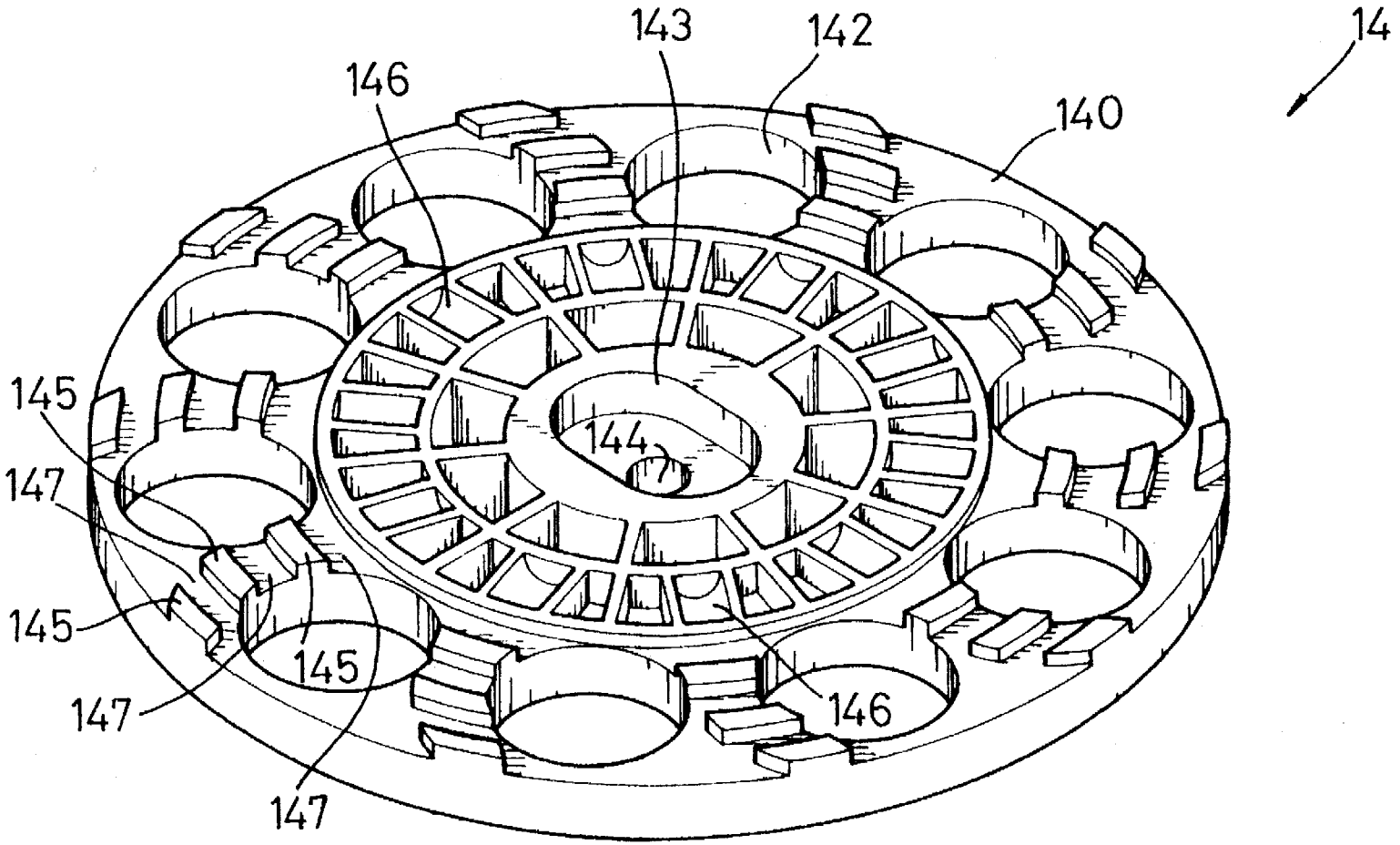
FIG. 2 is a schematic view showing the bottom of the turntable of the apparatus for sorting, counting and dispensing tokens in accordance with the present invention.

A driving block 13, configured as a long stem with a pair of curved sides, is mounted on the holder 11. The driving block 13 defines a central hole 131 which receives the spindle 121 of the electric motor. A turntable 14, which can be rotated about the spindle 121 of the electric motor 12 is mounted on the holder 11. The surface 140 of the turntable 14 is configured with a boss 141 at a center thereof. The boss 141 defines a hole 144 for the spindle 121 to further extend therethrough. An undersurface of the turntable 14 is designed as shown in FIG. 2. It can be seen that the turntable 14 defines a slot 143 at a center thereof for receiving the driving block 13, a plurality of ducts 146 arranged annularly around the slot 143 for respectively containing a plurality of ball races, wherein the ball races can be made in the form of rollers or balls, and a plurality of recesses 142 spaced and arranged annularly around the ducts 146 for receiving the tokens. The turntable 14 further has a plurality of flanges 145 extending integrally and upwardly from the surface between each adjacent recess 142 thereof. The flanges 145 are spaced and arranged at position radially outward of the surface between adjacent recesses 142 so as to form a plurality of channels 147 therebetween by which the fingers 161 of the block 16 of the holder 11 can extend thereinto.

The hopper 15 has an opening at a top thereof and defines a central hole 151 with a diameter slightly larger than that of the turntable 14 at a bottom thereof for fitting over the turntable 14. A periphery defining 151 has a ledge 152 integrally extending from an upper portion of the periphery thereof in order to retain the periphery of the turntable 14. The hopper 15 further comprises a movable baffle plate 153 crossing thereover at an upper portion and a plurality of lugs 154 each defining a bore and integrally extending from the bottom thereof by which the hopper 15 can be mounted to the holder 11.

A locating member 20 is mounted on the holder 11. The locating member 20 includes a first guide vane 22 and a second guide vane 23 sandwiched between a cover plate 21 and a first carrier plate 24 thereof. The first and second guide vane 22, 23 respectively have a thickness larger than that of a token and define a plurality of apertures (not numbered) therein. The first and second guide vane 22, 23 are co-planar and are spaced apart from each other. Additionally, the first and second guide vanes 22, 23 respectively define an arch 221, 231 at an opposed side thereof so that a first passage 25 (with a reference to FIGS. 3 and 4) is defined therebetween. It is appreciated that the first and second guide vanes 22 and 23 can also be made as a single integral unit.

A guide member 30 is mounted above the locating member 20. The guide member 30 includes a first platen 31, a second platen 32 and a second carrier plate 33 supporting the two platens 31 and 32. The first and the second platen 31,32 respectively define a plurality of apertures 313, 323 and have a protrusion 311, 321 extending from a lower side thereof for engaging with the locating member 20. Furthermore, the first and second platens 31, 32 are co-planar and respectively have a flange 312, 322 extending from an opposed side thereof, which has a width slightly larger than the thickness of a token. The first and second platens 31, 32 are spaced apart from each other and define a second passage 35 (with a reference to FIGS. 3 and 4) in communication with the first passage 25 of the locating member 20. The second carrier plate 33 defines a plurality of apertures 332 corresponding to the apertures 313, 323 on the platens 31, 32 and has a set piece 331 integrally extending from a lower side thereof with holes therein.

Figure 4:
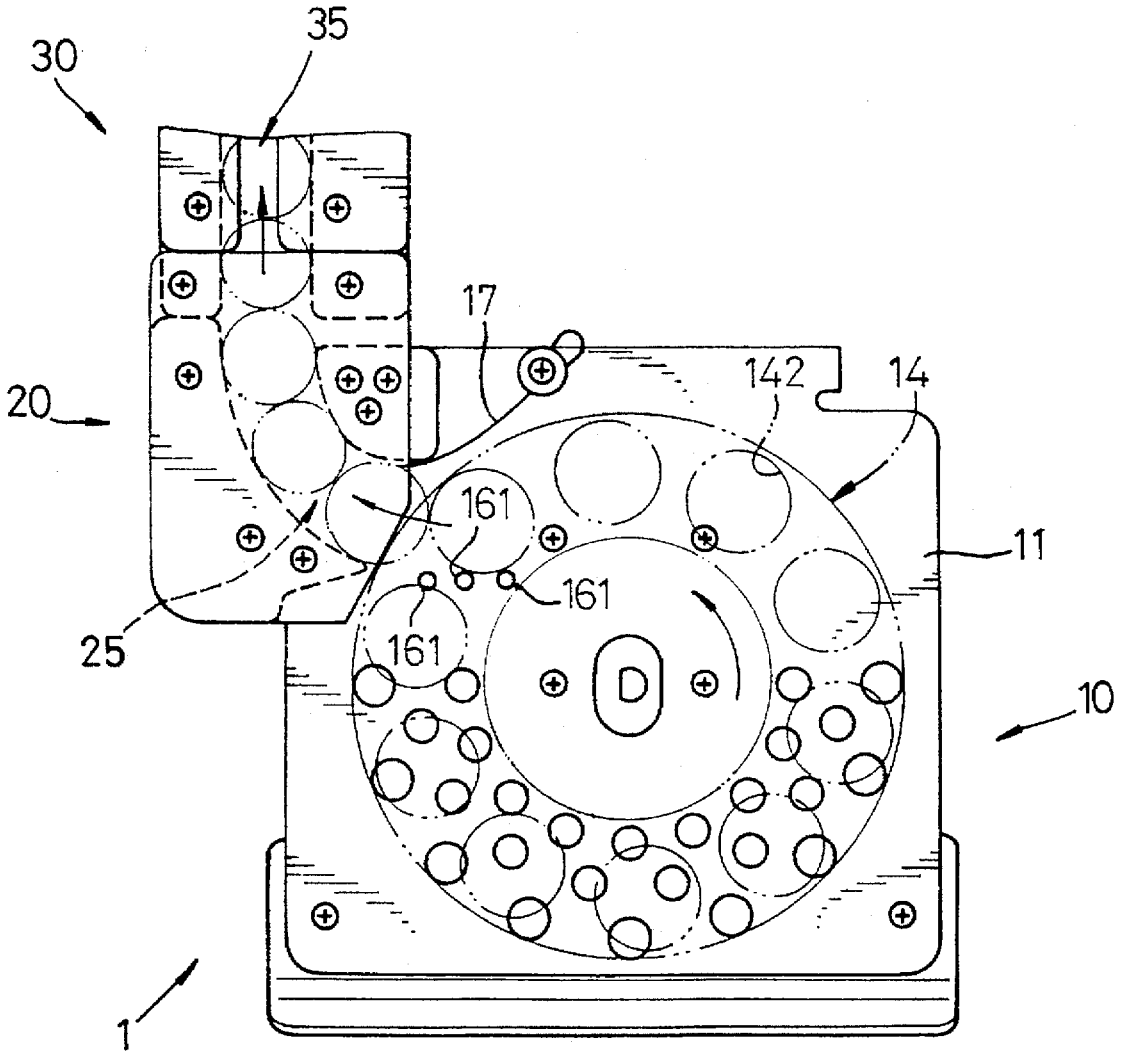
FIG. 4 is a first plane view showing the operation of the apparatus for sorting, counting and dispensing tokens in accordance with the present invention.

In addition, with reference to FIG. 4, a stop lever 17 is provided on the holder 11 for preventing the tokens falling backwardly from the passages 25 and 35. The stop lever 17 has a first end thereof pivotedly mounted on the holder 11 at an appropriate position, the first end being configured as a hook, and a second end with a flexible portion blocking at an entry of the first passage 25.

Figure 3:
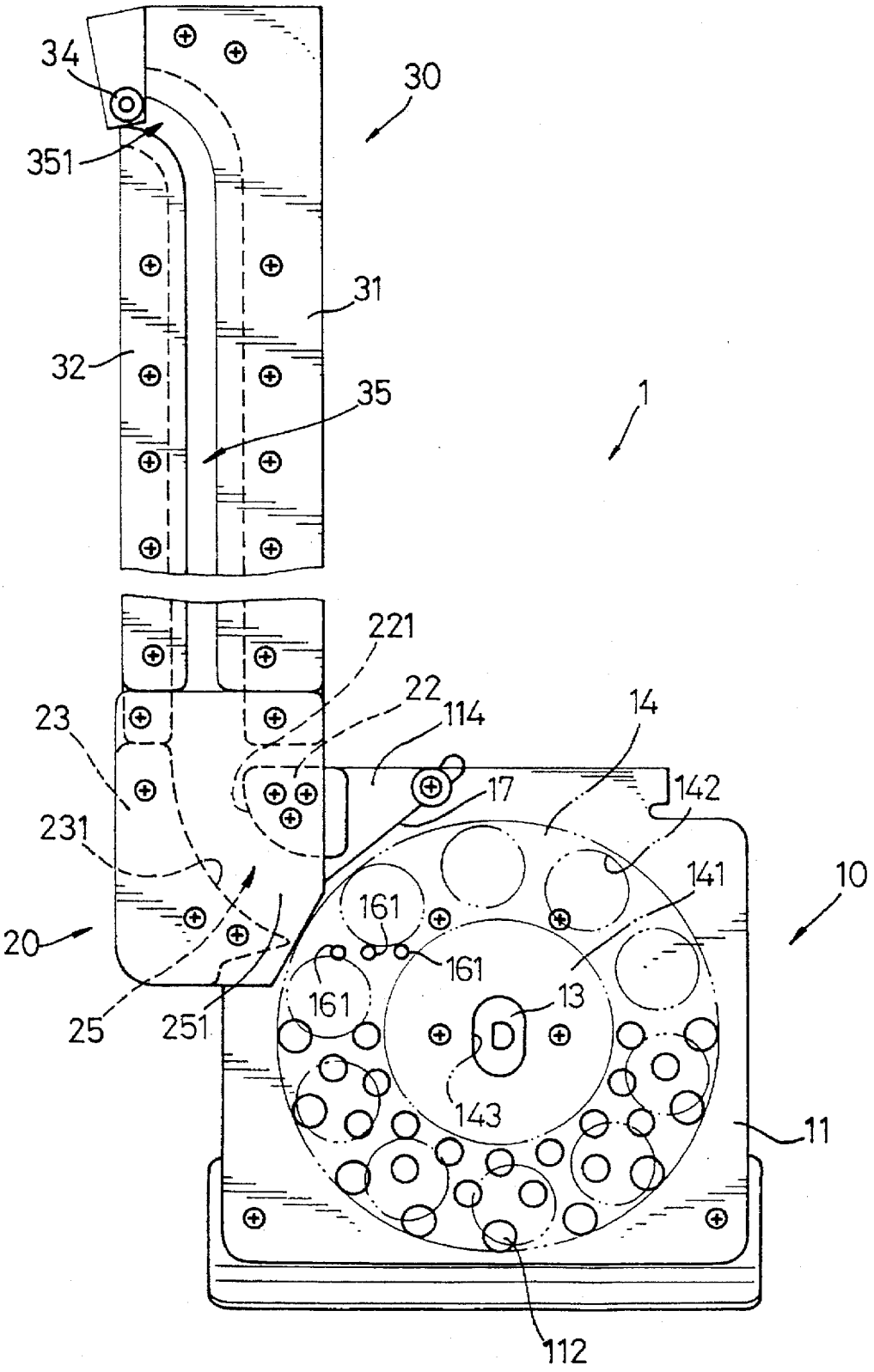
FIG. 3 is a plane view showing the combined structure of the apparatus for sorting, counting and dispensing tokens in accordance with the present invention.

FIG. 3 is a plane view showing the combined structure of the apparatus for counting tokens in accordance with the present invention. In assembly, a spacer 122 (see FIG. 1) is set on the spindle 121 which has been inserted through the holder 11. Then the driving block 13 is mounted to the holder 11 and fastened with the spindle 121. Next, the plurality of ball races is disposed within the ducts 146 at the bottom of the turntable 14 and the slot 143 of the turntable 14 is set on the driving block 13 and engaged with the spindle 121, whereby the turntable 14 can be driven to rotate by the spindle 121 of the electric motor 12.

Then, the hook portion of the stop lever 17 is engaged onto the holder 11 by means of a screw. The first and second guide vanes 22, 23 are sandwiched between the cover plate 21 and the first carrier plate 24 to form the locating member 20. In this case, the second end of the stop lever 17 is located at an entry 251 of the first passage 25 defined by the first and second guide vanes 22, 23. Then the locating member 20 is fixedly mounted to a portion 114 on the holder 10 by means of respectively mounting the cover plate 21 and the protrusion of the carrier plate 24 onto a front side and a rear side of the portion 114. Then the first and second platen 31, 32 are respectively mounted to the second carrier plate 33 in a manner to define the second passage 35 therebetween. A first counter 34 may be mounted at an exit 351 of the second passage 35 for counting the tokens. Then the flanges 311, 321 of the first and second platens 31, 32 are respectively inserted and mounted between the space defined by the cover plate 21 and the first carrier plate 24 of the locating member 20 so that the second passage 35 of the guide member 30 is in communication with the first passage 25 of the locating member 20.

Finally, the hopper 15 has its central hole 151 set on the turntable 14 and is mounted via the to apertures 113 of the holder 11 by respectively aligning with the bores of the lugs 154 thereof so that screws may extend therethrough. The ledge 152 of the hopper 15 exactly retains the periphery of the turntable 14 so that the turntable 14 can be operated within the limitation of the ledge 152, without being separated from the hopper 15. Additionally, the baffle plate 153 is located over the boss 141 of the turntable 14 so that the tokens are prevented from pressing the spindle 121 directly, thereby to reduce the burden applied on the electric motor 12. Alternatively, a second counter 18 and a second guide member (not shown) may be mounted adjacent to the portion 114 on the holder 11 to deliver the tokens from the side of the holder 11.

Figure 5:
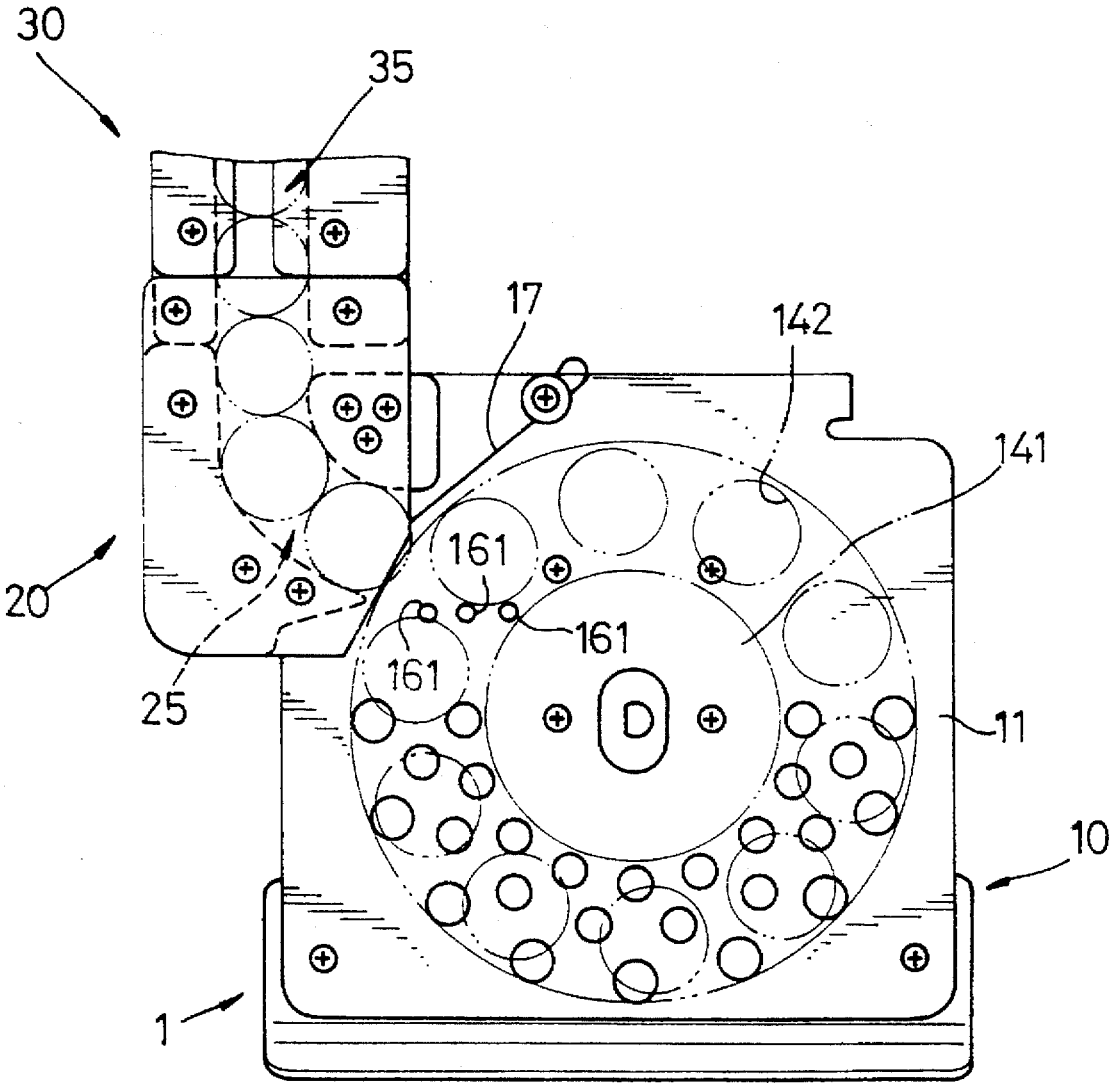
FIG. 5 is a second plane view showing the operation of the apparatus for sorting, counting and dispensing tokens in accordance with the present invention.

In operation, with reference to FIGS. 4 and 5, when the apparatus 1 for counting is powered up, the turntable 14 is driven to rotate by the electric motor 12 and the tokens are arranged within the recesses 142 one by one on the surface of the turntable 14 during rotation. Due to the shift of the block 16 between the flanges 145 during rotation, the tokens will be guided in turn into the first passage 25 of the locating member 20 via the stop lever 17 in a straight forward direction. Since the turntable 14 continues to rotate and deliver the tokens, the prior tokens will be pushed in the first and second passages 25, 35. When the apparatus 1 stops working, some tokens will remain in the passages 25 and 35. In this case, the stop lever 17 can prevent these tokens from falling back into the turntable 14.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved apparatus for sorting, counting and dispensing tokens comprising:

a housing;

a holder obliquely mounted on the housing, said holder having a plurality of fingers disposed at an upper portion thereof;

a turntable rotatingly mounted on the holder, said turntable defining a slot at a center thereof for receiving a driving block, a plurality of ducts arranged annularly around the slot for respectively containing a plurality of ball races, and a plurality of recesses spaced and arranged annularly around the ducts for receiving the tokens, said turntable further having a plurality of flanges extending annularly and toward said holder from a surface between each adjacent recess, said flanges being radially spaced so as to form a plurality of channels therebetween for the fingers of the holder to extend thereinto;

a locating member mounted on the holder, said locating member defining a first passage communicated with the turntable for the tokens to pass therethrough;

a guide member mounted above the locating member, said guide member defining a second passage in communication with the first passage;

a hopper for containing tokens mounted to the holder over the turntable, said hopper defining a central hole with a diameter slightly larger than that of the turntable for mating with the turntable, said central hole having a ledge integrally extending from an upper portion of a periphery thereof in order to retain the turntable; and an electric motor mounted behind the housing to drive the turntable to rotate, whereby the tokens are delivered one by one from the turntable to the locating member.

2. The apparatus as claimed in claim 1, wherein said plurality of ball races are in the form of rollers.

3. The apparatus as claimed in claim 1 further comprising a stop lever having a first end thereof pivotedly mounted on the locating member at an appropriate position and a second end with a flexible portion blocking an entry of the first passage in order to prevent tokens from falling backwardly.

4. The apparatus as claimed in claim 1, wherein said locating member comprises a first guide vane and a second guide vane sandwiched between a cover plate and a carrier plate, said first and second guide vane being spaced apart from each other to define the first passage therebetween.

5. The apparatus as claimed in claim 4, wherein said first and second guide vanes and said cover plate of the locating member are formed integrally.

* * * * *